United States Patent [19]

Zsuppan

[11] 3,960,467

[45] June 1, 1976

[54] COOLING DEVICE FOR A PUMP MOTOR

[75] Inventor: Miklos Zsuppan, Ekero, Sweden

[73] Assignee: International Standard Electric Corporation, New York, N.Y.

[22] Filed: Sept. 16, 1974

[21] Appl. No.: 506,511

Related U.S. Application Data

[63] Continuation of Ser. No. 338,980, March 7, 1973, abandoned.

[52] U.S. Cl. ..... 417/366; 417/368; 310/64

[51] Int. Cl.[2] ..... F04B 39/06

[58] Field of Search ..... 417/366, 368; 310/87, 310/63, 64; 165/108; 917/424

[56] References Cited

UNITED STATES PATENTS

| | | | |
|---|---|---|---|
| 2,605,312 | 7/1952 | Boyer | 310/64 X |
| 2,654,583 | 10/1953 | Treanor | 165/108 |
| 3,025,799 | 3/1962 | Hallerback | 417/366 X |
| 3,044,406 | 7/1962 | Kristenson | 417/366 X |
| 3,401,745 | 9/1968 | Pato et al. | 165/108 X |
| 3,653,785 | 4/1972 | Dahlgren et al. | 417/368 X |

*Primary Examiner*—Carlton R. Croyle
*Assistant Examiner*—Thomas I. Ross
*Attorney, Agent, or Firm*—J. B. Raden; D. P. Warner

[57] ABSTRACT

A jacket of a submersible pump motor is provided with an internal partition wall to provide chambers through which dry air may be circulated in the event that cooling fluid into the pump runs out. When the pump turns, its impeller forces the air to circulate around the partition wall and carry heat from hot areas of the jacket adjacent to the pump motor to be dissipated through cool outer areas of the jacket.

5 Claims, 5 Drawing Figures

COOLING DEVICE FOR A PUMP MOTOR

This is a continuation of application Ser. No. 338,980 filed Mar. 7, 1973, now abandoned.

BACKGROUND OF THE INVENTION

1. Field of the Invention

A submersible pump is disclosed having a cooling jacket for cooling the pump and the motor when a liquid medium is pumped through the jacket. To enable the pump to continue to function without overheating in the absence of a liquid medium, a partition is provided within the jacket to cause air to circulate and transfer heat from hot portions to cool portions of the jacket.

2. Description of the Prior Art

A submersible pump is able to work above as well as in the pumped medium. Especially by submersible drainage pumps, which are intended for pumping water that is comparatively free from pollution, it is common to let the pumped water pass around the driving motor of the pump on its way towards the outlet pipe. An electric motor needs cooling and a suitable way to bring this about is to arrange a housing (jacket) around the motor and let the water pass this jacket on its way to the outlet. As new water is brought in continuously the cooling will be very good.

However, a submersible drainage pump must be able to run dry, which means that the pump must be able to run during a long time without getting overheated even if the water is gone. As it often happens that the pump outlet is closed because of the fact that the outlet pipe does not end in the open air but under a water surface for instance, the jacket which surrounds the motor, then will contain air which more or less is stagnant and therefore the thermal dissipation is very poor. That situation involves great risks for overheating in a pump motor which normally would get enough cooling.

SUMMARY OF THE INVENTION

According to the invention this problem is solved in that the part of the cooling jacket which surrounds the envelope surface of the motor is parted by a partition wall into two partly separated rooms. In this way a circulation of air in the jacket is obtained which means a better thermal dissipation in the form of thermal transport.

BRIEF DESCRIPTION OF THE DRAWINGS

The invention is described more closely below with reference to the attached drawings, in which.

DESCRIPTION OF A PREFERRED EMBODIMENT

Figure 1:
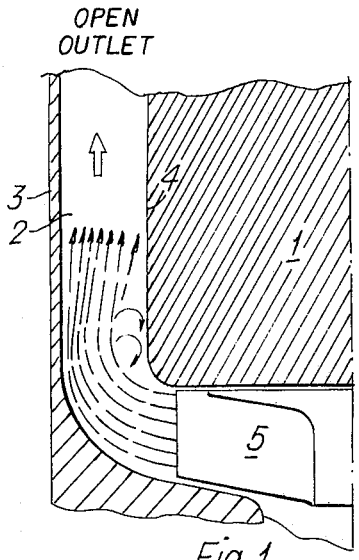
Fig. 1. PRIOR ART
FIG. 1 shows a sectional view of a part of a conventional jacket-cooled pump during pumping.
Figure 2:
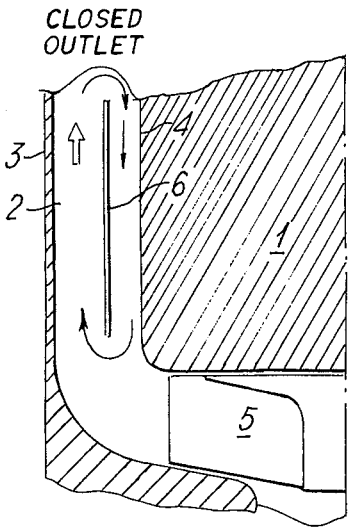
FIG. 2 shows a sectional view of a pump of the same type which is running dry and has a closed outlet and where the jacket has a partition wall.

In the FIGS., 1 stands for a pump motor which is not closely shown, 2 stands for a cooling jacket surrounding the motor, 4 represents an inner wall, 3 represents an outer wall, 6 is a partition wall and 5 is an impeller.

The water which will be pumped comes in by the center of the impeller 5 and is thrown out by the centrifugal force against the outer wall of the pump housing and is then pressed upwards through the cooling jacket 2. In this way a good cooling of the pump motor 1 is obtained. However, if the water gives out the cooling jacket will just contain air, which as discussed before has a very poor thermal dissipation ability. By arranging a partition wall 6 in the form of a pipe concentric to the motor shaft, air is forced to circulate in the cooling jacket if the outlet is closed. Because of the influence of the impeller the air is forced to flow upwards outside the wall 6 and downwards along the stator of the motor 1. In this way the air will be warmed up by the stator and cooled by the colder outer wall 3. Much better cooling is obtained in this way than that which would be possible otherwise. Tests have shown that while keeping other conditions unchanged, it has been possible to keep the motor temperature for a certain pump type about 10° C lower when such a partition wall has been arranged in the cooling jacket.

Figure 3:
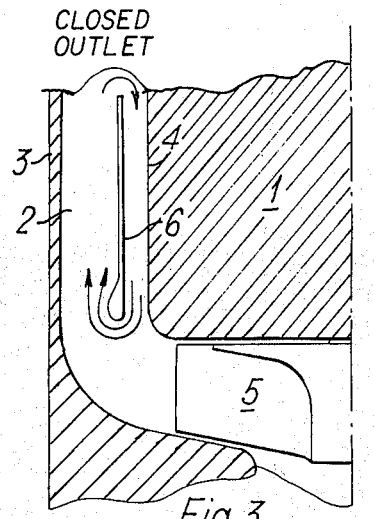
FIGS. 3 and 4 show sectional views of different embodiments and arrangements of such a partition wall.

In FIG. 3 is shown how the flow around the lower edge of the partition wall 6 may be improved by the fact that the edge has been thickened.

Figure 4:
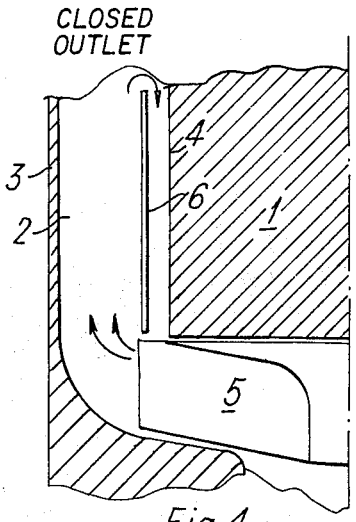
Figure 5:
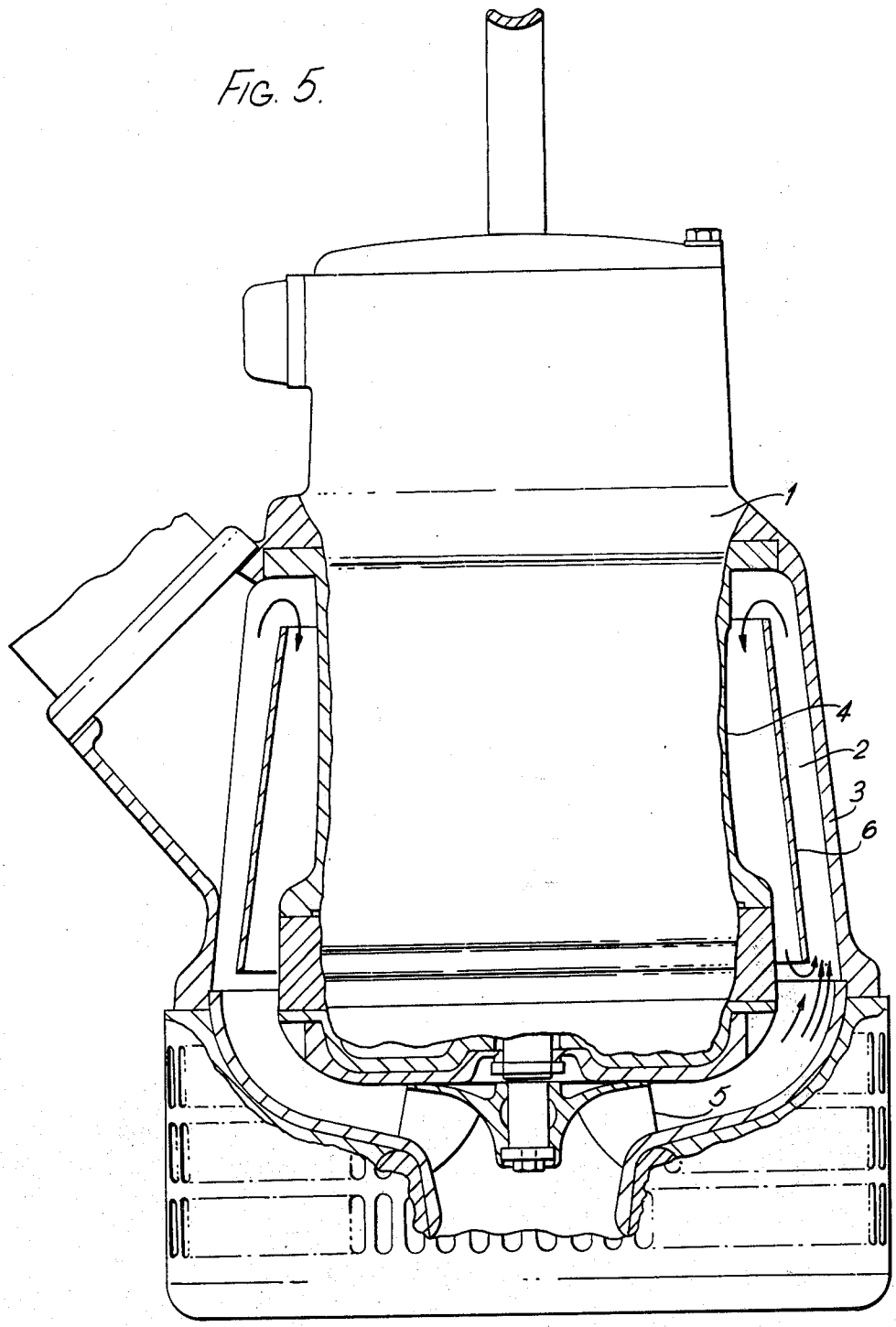
FIG. 5 is a sectional view of an exemplary pump employing principles of the invention.

In FIG. 4 finally, a pump is shown here a strong forced flow around the partition wall 6 is obtained by arranging the wall 6 close to the impeller 5. The impeller then acts as a fan.

While the principles of the invention have been described above in connection with specific apparatus and applications, it is to be undersood that this description is made only by way of example and not as a limitation on the scope of the invention.

I claim:

1. A cooling device for an electric pump motor to insure continued cooling when a liquid medium being pumped is exhausted comprising a cooling jacket at least partially surrounding an electric motor, said jacket providing a chamber and an outlet portion through which a liquid medium being pumped is forced to flow through action of a pump impeller coupled to the motor, and an open ended partition wall encircling the motor and dividing the chamber into two open-ended chamber parts formed as concentric inner and outer chamber parts, said pump impeller being positioned relative to said chamber parts to force air to circulate through the two chamber parts when the liquid medium is exhausted, whereby the air circulates to carry heat from hot portions of the jacket to be dissipated through cooler portions of the jacket, said pump impeller forcing air successively through the outer chamber part and the inner chamber part to carry heat from the electric motor to be absorbed by the cooling jacket when said outlet portion is effectively closed.

2. A cooling device according to claim 1, in which the partition wall is a cylinder concentric to the motor shaft and with a radius less than the outer limiting surface of the cooling jacket and bigger than the inner limiting surface of the cooling jacket.

3. A cooling device according to claim 2, in which the partition wall is placed in such a way that when the pump outlet is closed and the pumped medium is air, the latter is forced to circulate so that it passes outside the partition wall in one direction and inside the partition wall in the other direction

4. A cooling device according to claim 3, in which the partition wall is thickened at one or both ends in order to improve the flow around the respective ends.

5. A cooling device according to claim 1, in which the partition wall is placed close to the upper edge of the impeller so that the latter may maintain a forced flow of air around the partition wall.

* * * * *